US012116178B2

(12) United States Patent
Baird

(10) Patent No.: US 12,116,178 B2
(45) Date of Patent: Oct. 15, 2024

(54) LID WITH LOCKING FEATURE

(71) Applicant: Graphic Packaging International, LLC, Atlanta, GA (US)

(72) Inventor: Kyle Baird, Milwaukee, WI (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/482,767

(22) Filed: Sep. 23, 2021

(65) Prior Publication Data

US 2022/0097925 A1 Mar. 31, 2022

Related U.S. Application Data

(60) Provisional application No. 63/083,313, filed on Sep. 25, 2020.

(51) Int. Cl.
*B65D 43/02* (2006.01)

(52) U.S. Cl.
CPC ..... *B65D 43/0212* (2013.01); *B65D 2543/00046* (2013.01); *B65D 2543/00092* (2013.01);
(Continued)

(58) Field of Classification Search
CPC ..... B65D 43/0212; B65D 2543/00046; B65D 2543/00092; B65D 2543/00527;
(Continued)

(56) References Cited

U.S. PATENT DOCUMENTS 2,313,784 A * 3/1943 Then ..... B65D 47/265 222/557
3,106,311 A * 10/1963 Fairchild ..... B65D 39/0023 220/269

(Continued)

FOREIGN PATENT DOCUMENTS

| | | | | |
|---|---|---|---|---|
| CH | 712478 | A1 | 11/2017 | |
| EP | 849187 | A2 * | 6/1998 | ..... B65D 43/0256 |
| EP | 2 295 338 | A1 | 3/2011 | |
| EP | 2 639 180 | A | 9/2013 | |
| JP | 62-271839 | A | 11/1987 | |

(Continued)

OTHER PUBLICATIONS

International Search Report and Written Opinion for PCT/US2021/051656 dated Jan. 7, 2022.

(Continued)

*Primary Examiner* — Don M Anderson
*Assistant Examiner* — John Martin Hoppmann
(74) *Attorney, Agent, or Firm* — Womble Bond Dickinson (US) LLP

(57) ABSTRACT

A lid for a container. The lid comprises a central wall and a dispenser comprising a dispenser flap hingedly connected to the central wall and moveable between a closed configuration and an open configuration at least partially exposing a dispenser opening in the central wall. The dispenser further can include a projection extending from the dispenser flap. The lid further comprises a locking feature for maintaining the dispenser in the open configuration. The locking feature can comprise a locking recess in the central wall for at least partially receiving the projection. The dispenser opening can be located on a centerline of the lid, and the locking recess can be spaced away from the centerline of the lid.

22 Claims, 7 Drawing Sheets

(52) U.S. Cl.
CPC ..... *B65D 2543/00527* (2013.01); *B65D 2543/00537* (2013.01); *B65D 2543/00638* (2013.01); *B65D 2543/00685* (2013.01); *B65D 2543/00759* (2013.01); *B65D 2543/00796* (2013.01)

(58) Field of Classification Search
CPC ..... B65D 2543/00537; B65D 2543/00638; B65D 2543/00685; B65D 2543/00759; B65D 2543/00796; B65D 43/02; B65D 43/00; B65D 47/08; A47G 19/2272
USPC ..... 220/254.1, 254.3, 711, 816, 712; 215/387; 222/557
See application file for complete search history.

(56) References Cited

U.S. PATENT DOCUMENTS 3,355,058 A 11/1967 Asbury
3,362,569 A 1/1968 Geiger
3,797,696 A 3/1974 Dirbell
3,927,794 A 12/1975 Erdman
4,056,210 A 11/1977 Boyle
4,081,103 A 3/1978 Zoellick
4,106,660 A 8/1978 Boyle
4,113,135 A 9/1978 Yamazaki
4,127,212 A 11/1978 Waterbury
4,138,033 A 2/1979 Payne
4,184,604 A 1/1980 Amberg
4,190,174 A 2/1980 Haimowitz
4,206,854 A 6/1980 Takami
4,210,256 A 7/1980 Amberg et al.
4,245,752 A 1/1981 Prueher
4,350,260 A 9/1982 Prucher
4,394,928 A 7/1983 Philip
4,412,629 A 11/1983 Dart et al.
D271,945 S 12/1983 Ochs
4,460,103 A * 7/1984 Rama ..... B65D 47/0847 220/269
4,582,214 A 4/1986 Dart et al.
D285,416 S 9/1986 Dart
4,615,459 A 10/1986 Clements
D287,919 S 1/1987 Clements
4,678,096 A 7/1987 LaBarge et al.
D299,010 S 12/1988 Wall
5,050,758 A 9/1991 Freeman et al.
5,186,348 A 2/1993 Steiner
D338,621 S 8/1993 Balson
D352,455 S 11/1994 Balson
D354,438 S 1/1995 Miller
D358,294 S 5/1995 Letica
D360,133 S 7/1995 Boller
D368,624 S 4/1996 Forrer
D379,588 S 6/1997 Pledger
D380,385 S 7/1997 Litke
5,678,720 A 10/1997 Van Melle
5,699,927 A 12/1997 Lane et al.
5,820,016 A 10/1998 Stropkay
5,897,019 A 4/1999 Stropkay
6,089,397 A 7/2000 Van Melle
6,220,470 B1 4/2001 McHenry et al.
D447,412 S 9/2001 Durdon
6,523,712 B1 2/2003 McGushion
6,612,456 B1 9/2003 Hundley et al.
D480,968 S 10/2003 Atkins
D481,312 S 10/2003 Martin
D481,633 S 11/2003 Schmidtner
6,644,490 B2 11/2003 Clarke
D517,322 S 3/2006 Zettle
7,111,749 B1 9/2006 Akers
D533,777 S 12/2006 Hundley
D560,120 S 1/2008 Maravich
D564,354 S 3/2008 Maravich
D570,685 S 6/2008 Koennecke
D572,587 S 7/2008 Rush
D574,238 S 8/2008 Walker
D585,279 S 1/2009 Walker
D614,954 S 5/2010 Crowell
D624,413 S 9/2010 Selina
D632,174 S 2/2011 Charbonnet
D641,239 S 7/2011 Ramsey
D641,622 S 7/2011 Fields
D641,623 S 7/2011 Fields
D643,718 S 8/2011 Fields
D647,400 S 10/2011 Fields
D649,049 S 11/2011 Fields
D672,235 S 12/2012 Chapin
D682,611 S 5/2013 Carder
D687,144 S 7/2013 Gronberg
8,474,643 B2 7/2013 Hundley
D694,625 S 12/2013 Maxwell
D695,612 S 12/2013 Chou
D696,113 S 12/2013 Stein
D696,940 S 1/2014 Hale
D703,044 S 4/2014 Chou
8,701,914 B1 4/2014 Buck
D704,053 S 5/2014 Kim
D709,366 S 7/2014 Fleming
8,789,718 B1 7/2014 Daniel
D716,141 S 10/2014 Rush
D722,498 S 2/2015 Fleming
D722,873 S 2/2015 Wu
9,238,529 B1 1/2016 Newman
D749,889 S 2/2016 Magistro
D752,975 S 4/2016 Gatto
D761,104 S 7/2016 Buck
D761,649 S 7/2016 Buck
D767,391 S 9/2016 Buck
D776,529 S 1/2017 Torrison
9,751,665 B2 9/2017 Fleming
D828,160 S 9/2018 Baird et al.
D834,419 S 11/2018 Baird et al.
D838,590 S 1/2019 Lee
D838,591 S 1/2019 Lee
10,279,965 B2 5/2019 Enghard
D850,258 S 6/2019 Savenok
10,351,308 B1 * 7/2019 Schaefer ..... B65D 47/2018
D867,134 S 11/2019 Savenok
D876,233 S 2/2020 Pan
D878,917 S 3/2020 Savenok
10,683,147 B2 6/2020 Choltco-Devlin et al.
10,940,979 B1 3/2021 Gillespie
10,940,980 B1 * 3/2021 Schaefer ..... B65D 51/18
D945,264 S 3/2022 Eickhoff
D961,387 S 8/2022 Milan
2003/0089726 A1 5/2003 Mazzarolo
2003/0218017 A1 11/2003 Schmidtner et al.
2005/0109780 A1 5/2005 Pendergrass
2006/0071008 A1 4/2006 Sadlier
2006/0096983 A1 5/2006 Patterson
2007/0095832 A1 5/2007 Hollis
2008/0185383 A1 8/2008 Philippe
2009/0008391 A1 1/2009 Bjorkholm
2009/0026219 A1 1/2009 Bal
2009/0032543 A1 2/2009 Lee
2010/0288769 A1 11/2010 Cheng
2011/0062158 A1 3/2011 Hung
2012/0048856 A1 3/2012 Walker
2012/0097690 A1 4/2012 Chien
2012/0152968 A1 6/2012 Bailey
2012/0261417 A1 * 10/2012 Tabor et al. ..... B65D 51/18
2013/0240546 A1 9/2013 Chen
2015/0251818 A1 9/2015 Strachan
2016/0007780 A1 1/2016 Dolan
2016/0058223 A1 3/2016 Savenok
2016/0270571 A1 * 9/2016 Wang ..... A47G 19/2272
2016/0325883 A1 11/2016 Wu
2016/0325890 A1 11/2016 Hong
2017/0238740 A1 8/2017 Steiert
2019/0367228 A1 12/2019 Wang

(56) References Cited

U.S. PATENT DOCUMENTS

| | | | |
|---|---|---|---|
| 2020/0062462 | A1 | 2/2020 | Baird |
| 2022/0097925 | A1 | 3/2022 | Baird |

FOREIGN PATENT DOCUMENTS

| | | | |
|---|---|---|---|
| JP | D1243010 | | 6/2005 |
| JP | 2007-290717 | A | 11/2007 |
| KR | 10-2010-0109627 | A | 10/2010 |
| KR | 10-1014806 | B1 | 2/2011 |
| KR | 300613814.0000 | | 9/2011 |
| WO | WO 2015/036113 | A1 | 3/2015 |

OTHER PUBLICATIONS

Black Plastic Straw: Announced (May 19, 2022; online). Site Visited (Dec. 17, 2022). Available from URL: https://www.restaurantware.com/disposables/coffee-cups-accessories/coffee-cup-lids/black-plastic-2-in-1-straw-or-sip-coffee-cup-lid-fits-8-12-16-and-20-oz-100-count-box/.

Black Flip Top Hot Cup Lid: Announced (Sep. 9, 2020 (online)). Site Visited (Dec. 17, 2022). Available from URL: https://hotcupfactory.com/collections/hot-cup-lids/products/black-flip-top-hot-cup-lids-8-10-12-16-20-22-oz.

Solo Hot Cups: Announced Mar. 15, 2011 [online], site visited [Aug. 17, 2017]. Available from Internet URL: https://www.uline.com/BL_6563/Hot-Cups.

Uline Paper Hot Cups: announced Jul. 5, 2014 [online], site visited [Aug. 17, 2017]. Available from Internet URL: https://www.uline.com/BL_540/Paper-Hot-Cups.

Choice 10 ox. Paper Hot cup Lid: site visited Aug. 17, 2017. Available from Internet URL: https://www.webstaurantstore.com/choice-10-oz-paper-hot-cup-lid-and-sleev-e-combo-kit-pack/99910CAFE25.html.

* cited by examiner

LID WITH LOCKING FEATURE

CROSS-REFERENCE TO RELATED APPLICATIONS

This application claims the benefit of U.S. Provisional Patent Application No. 63/083,313 filed on Sep. 25, 2020.

INCORPORATION BY REFERENCE

The disclosures of U.S. Provisional Patent Application No. 63/083,313, which was filed on Sep. 25, 2020, and U.S. Design patent application No. 29/777,448, which was filed on Apr. 6, 2021, are hereby incorporated by reference for all purposes as if presented herein in their entirety.

BACKGROUND

The present disclosure relates to lids for containers (e.g., beverage cups) for containing and/or dispensing fluids (e.g., beverages). More specifically, the disclosure is generally directed to a lid having a dispenser and a locking feature for one or more portions thereof.

SUMMARY

In general, one aspect of the disclosure is directed to a lid for a container. The lid comprises a central wall and a dispenser comprising a dispenser flap hingedly connected to the central wall and moveable between a closed configuration and an open configuration at least partially exposing a dispenser opening in the central wall. The dispenser further can include a projection extending from the dispenser flap. The lid further comprises a locking feature for maintaining the dispenser in the open configuration. The locking feature can comprise a locking recess in the central wall for at least partially receiving the projection. The dispenser opening can be located on a centerline of the lid, and the locking recess can be spaced away from the centerline of the lid.

According to another aspect of the disclosure, a method of forming a lid for a container comprises forming a central wall, a dispenser, and a locking feature for maintaining the dispenser in an open configuration. The dispenser comprises a dispenser flap hingedly connected to the central wall and moveable between a closed configuration and the open configuration at least partially exposing a dispenser opening in the central wall. The dispenser further can comprise a projection extending from the dispenser flap. The dispenser opening can be located on a centerline of the lid. The locking feature can comprise a locking recess in the central wall for at least partially receiving the projection. The forming the central wall, the dispenser, and the locking feature can comprise forming the locking recess at a location spaced away from the centerline of the lid.

According to another aspect of the disclosure, a container assembly comprises a lid engaged with a container. The lid comprises a central wall, an annular skirt extending downwardly with respect to the central wall and along at least a portion of the container, an annular ridge extending upwardly from the central wall, and a dispenser comprising a dispenser flap hingedly connected to the central wall and a projection extending from the dispenser flap. The dispenser flap can extend along at least a portion of a centerline of the lid when the dispenser flap is in a closed configuration. The lid further can comprise a locking feature for maintaining the dispenser in an open configuration. The locking feature can comprise a locking recess for at least partially receiving the projection. The locking recess can be spaced away from the centerline of the lid.

According to another aspect of the disclosure, a method of forming a container assembly comprises obtaining a lid comprising a central wall, an annular skirt extending downwardly with respect to the central wall, an annular ridge extending upwardly from the central wall, and a dispenser comprising a dispenser flap hingedly connected to the central wall and a projection extending from the dispenser flap. The dispenser flap can extend along at least a portion of a centerline of the lid when the dispenser flap is in a closed configuration. The lid further can comprise a locking feature for maintaining the dispenser in an open configuration. The locking feature can comprise a locking recess for at least partially receiving the projection. The locking recess can be spaced away from the centerline of the lid. The method further can comprise attaching the lid to an upper portion of the container so that the annular skirt extends along at least a portion of the container.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

Containers and lids according to the present disclosure can cooperate to accommodate fluids, e.g., liquid or semi-liquid beverages that can include one or more solid components, of different sizes and compositions. For the purpose of illustration and not for the purpose of limiting the scope of the disclosure, the following detailed description describes a container for tepid, warm, hot, cool, cold, and/or at least partially frozen beverages, e.g., hot coffee, hot tea, hot cocoa, hot cider, water, soda, iced coffee, cold brew coffee, blended ice beverages (such as smoothies, slush beverages, milkshakes, etc.), iced tea, lemonade, and other flavored or unflavored beverages (e.g., soft drinks), to name a few. It will be understood that the containers and lids described herein can contain different types of beverages having any suitable temperature and/or products containing one or more food items without departing from the disclosure.

As described herein, lids can be formed of a plastic material (e.g., a food grade polymer) and containers can be formed from blanks (e.g., paperboard blanks). In one embodiment, lids can be formed by thermoforming and/or injection molding and/or any other suitable forming method. Containers can be formed from the blanks by overlapping multiple portions, panels, and/or end flaps. Such portions, panels, and/or end flaps may be designated herein in terms relative to one another, e.g., "first," "second," "third," etc., in sequential or non-sequential reference, without departing from the disclosure. In another embodiment, the lids could be formed from paper products and/or the containers could be formed from plastic materials without departing from the disclosure. In this specification, the terms "inner," "interior," "outer," "exterior," "front," "back," "rear," "side," "lower," "bottom," "upper," and "top" indicate orientations determined in relation to fully erected and upright containers.

Figure 1:
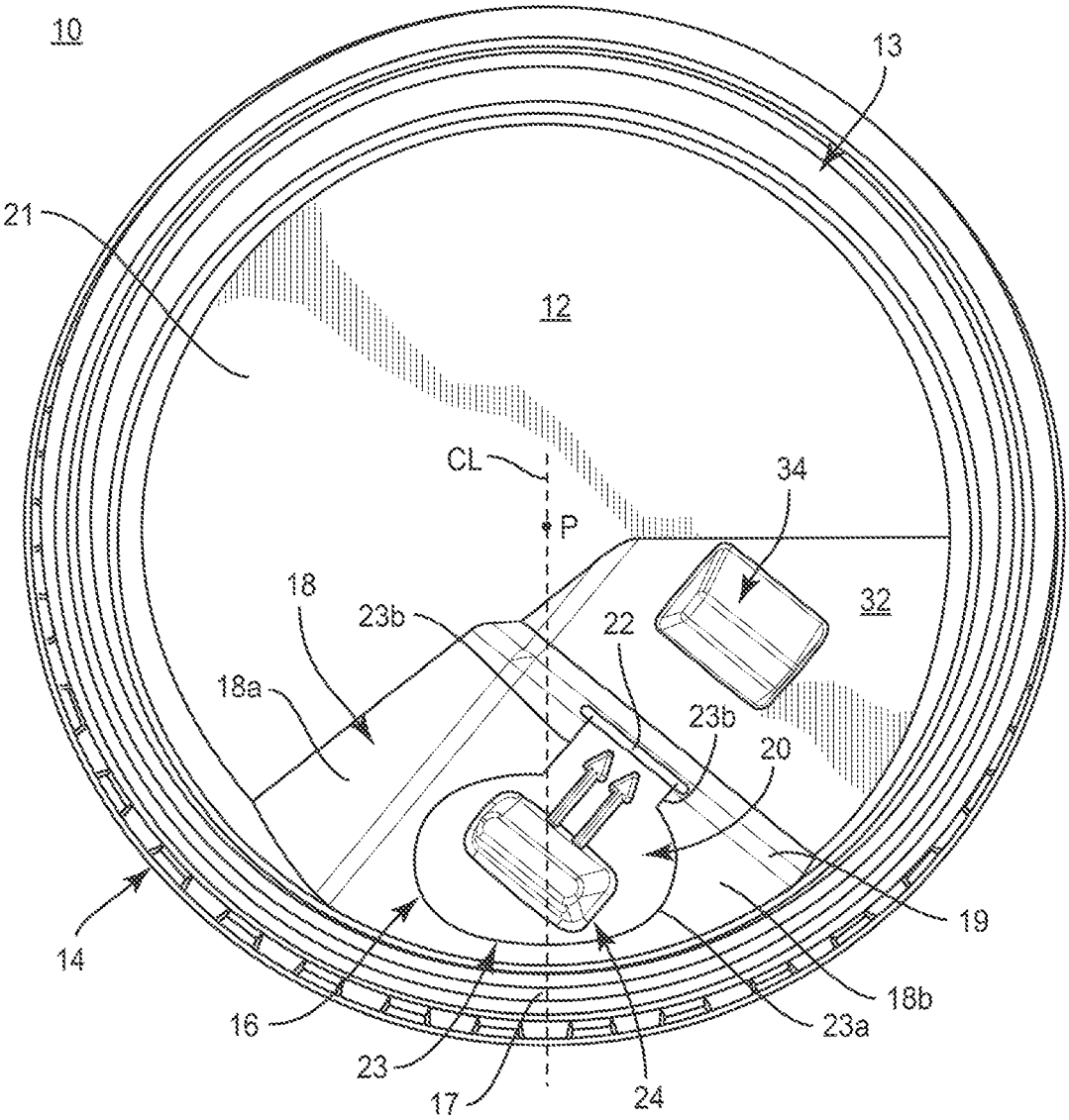
FIG. 1 is a plan view of a lid with a dispensing feature in a closed configuration according to an exemplary embodiment of the disclosure.
Figure 5:
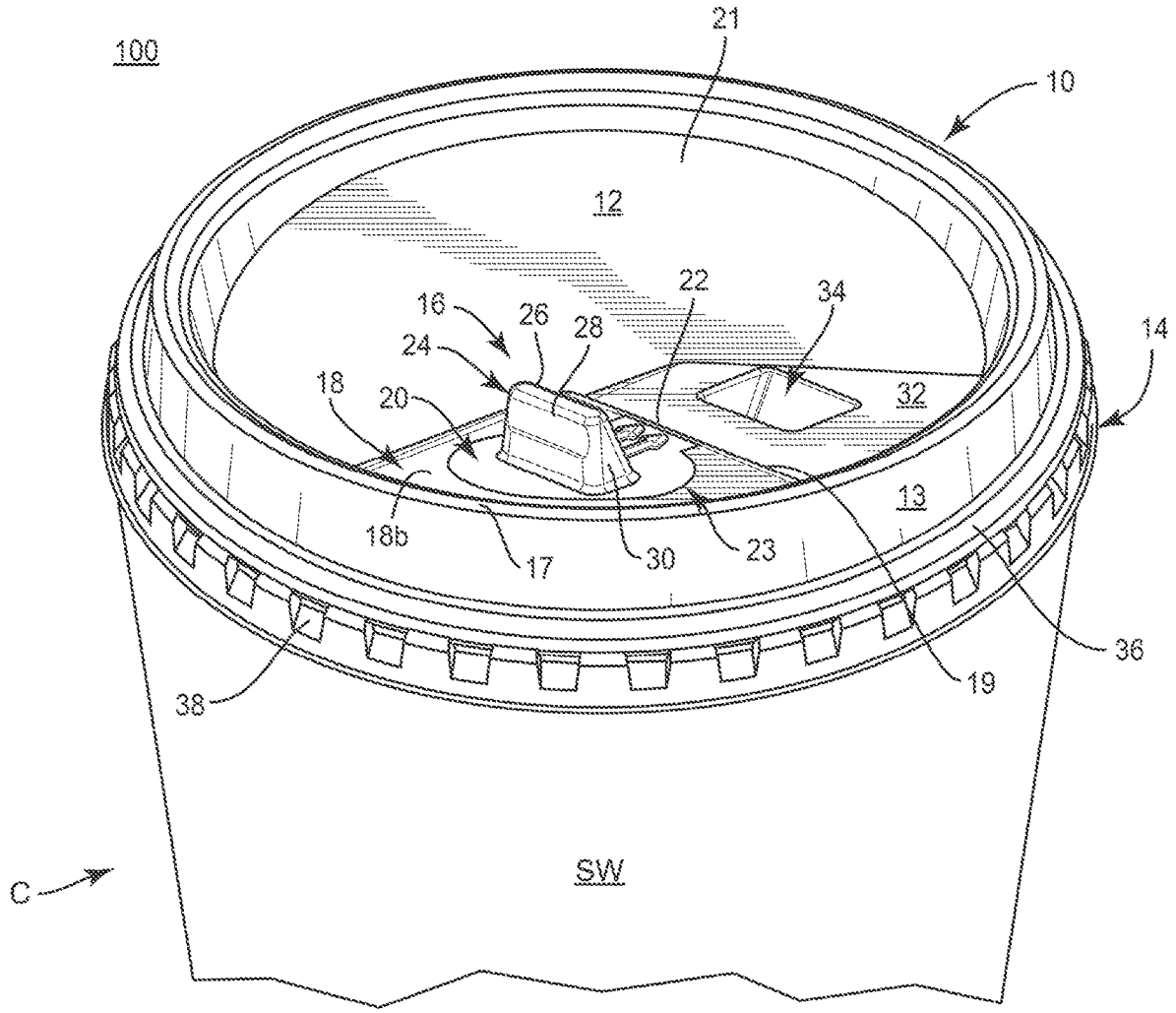
FIG. 5 is a perspective view of a container assembly with the container of FIG. 2 engaged with the lid of FIG. 1 in the closed configuration.
Figure 6:
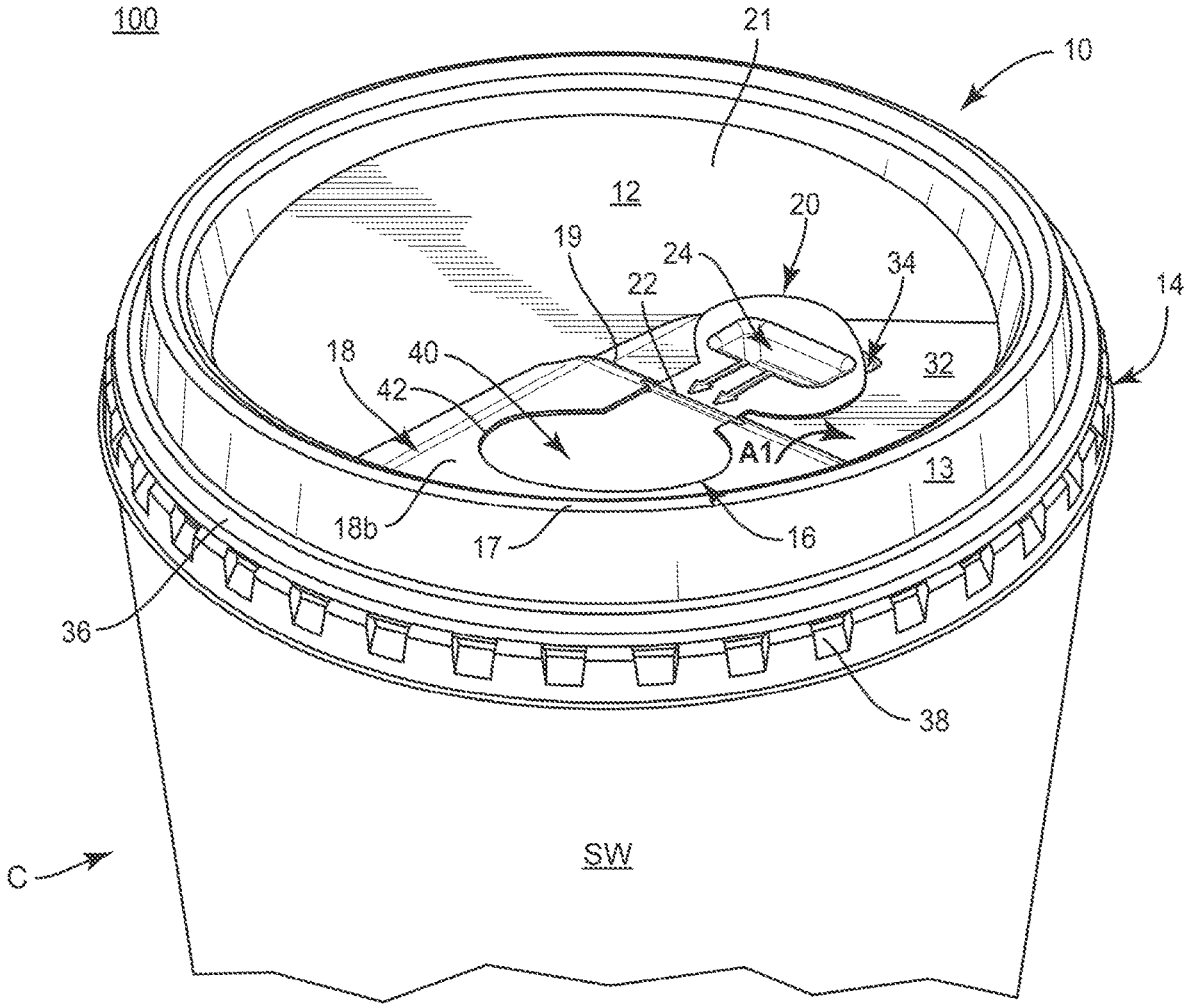
FIG. 6 is a perspective view of the container assembly of FIG. 5 with the dispensing feature of the lid in an open configuration.

In an exemplary embodiment, FIG. 1 illustrates a drinking lid 10 for attachment to a container C (FIG. 2), such as a drinking cup, so that the combined lid 10 and container C form a container assembly 100 (FIGS. 5 and 6). The container C can be configured for holding cold and/or hot beverages and/or other suitable items. In one embodiment, the container can hold hot beverages (e.g., tea, coffee, hot cocoa, hot cider and/or other suitable beverages). In another embodiment, the container can hold the container can hold cold beverages (e.g., soda, juice, milk, tea, coffee, cocktails, and/or other suitable beverages), with or without ice.

Figure 2:
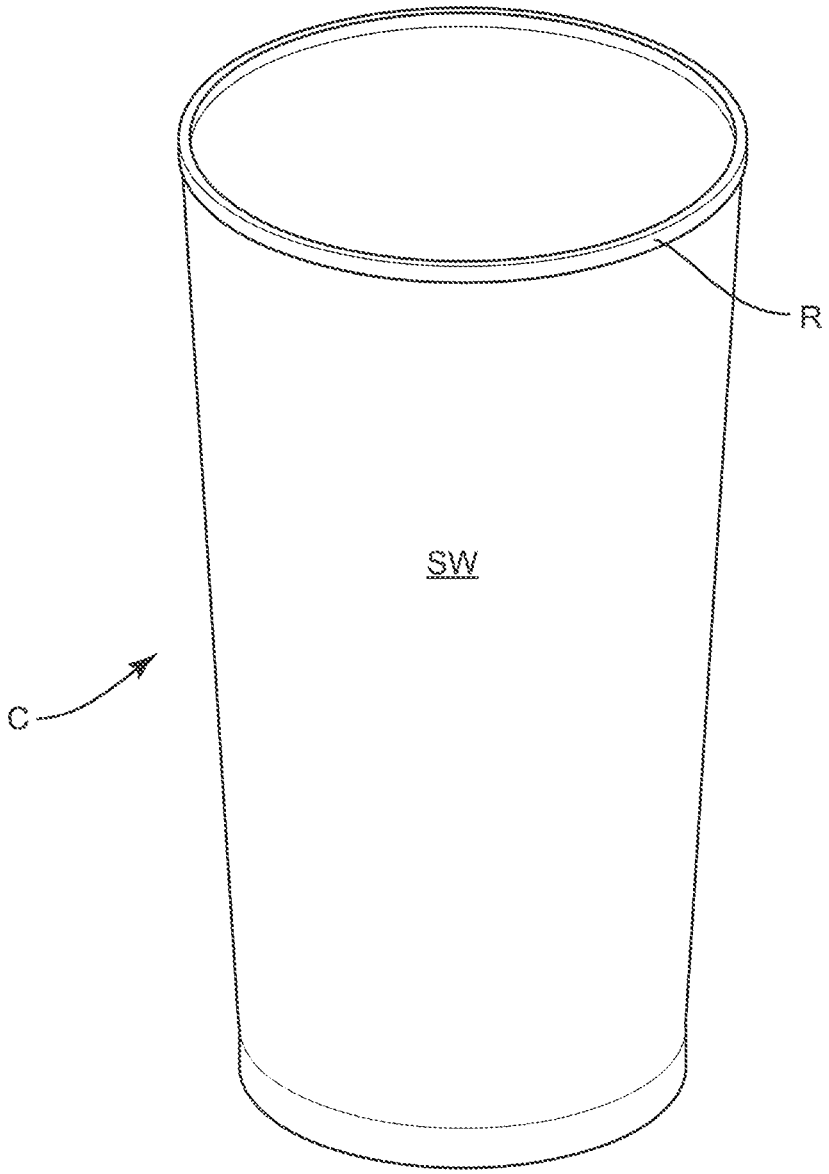
FIG. 2 is a perspective view of a container suitable for engagement with the lid of FIG. 1.

With additional reference to FIG. 2, in one embodiment, the container C can have a bottom wall (not shown) and a sidewall SW extending around an interior of the container C for holding the beverage or any suitable liquid. The container C further can include a rim R for receiving the lid 10 at a top end of the sidewall SW. It will be understood that the lid 10 can be configured for use with a container having a different configuration without departing from the disclosure. As described herein, the lid 10 can be attached to or otherwise engaged with the container C to provide a container assembly.

As shown in FIGS. 1 and 3-7, the lid 10 can include a top or central wall 12, an annular ridge 13 extending upwardly from the central wall 12, a flange or annular skirt 14 extending downwardly from the central wall 12 and the annular ridge 13, and an opening feature or dispenser 16 formed in the central wall 12. In the illustrated embodiment, the annular ridge 13 and the annular skirt 14 can each have a generally circular arrangement about a center point P. A centerline CL of the lid 10 can extend through the center point P and the dispenser 16, as shown. In one embodiment, the centerline CL can extend through a center of the dispenser 16. The centerline CL can intersect a portion 17 of the annular ridge 13 along which a user may position his or her mouth to retrieve fluids from the interior of the container C through the dispenser 16, as described further herein.

As shown in FIGS. 1 and 3-7, the central wall 12 can be recessed below the annular ridge 13 so as to form an interior space or ponding area so that any liquid on the top side of the lid 10 can collect in an area that is spaced away from the dispenser 16. In one embodiment, the central wall 12 also can include indicators (not shown) that can be selectively actuated (e.g., depressed) or marked to indicate the type of beverage that is contained in the container C. In embodiments, the central wall 12 optionally can include a vent (not shown), which can allow gases (e.g., from carbonated beverages) to escape from the interior of the container C and/or can allow air to enter the interior when liquids are dispensed through the dispenser 16. Alternatively, such indicators and/or a vent could be omitted. The central wall 12, the annular ridge 13, and/or the annular skirt could be omitted or could be otherwise shaped, arranged, positioned, and/or configured without departing from the disclosure.

In the illustrated embodiment, the dispenser 16 can include a dispenser panel 18 supported on the central wall 12 and a dispenser flap 20 hingedly/foldably connected to the dispenser panel 18 along a hinge 22. As shown in FIG. 1, the hinge can extend in an oblique direction with respect to the centerline CL. In an exemplary embodiment, the hinge 22 can be spaced apart from the centerline CL. As shown in at least FIGS. 1, 3, and 5, the dispenser panel 18 can have a side portion 18*a* extending upwardly from a base panel 21 of the central wall 12 and a top portion 18*b*, which can extend obliquely (e.g., so that the top portion 18*b* is slanted downwardly from the annular ridge 13 toward the center point P of the lid 10). In one embodiment, the dispenser panel 18 can be considered a portion of the central wall 12 such that the dispenser flap 20 is hingedly connected to the central wall 12 at the hinge 22.

As shown, the dispenser flap 20 can be separable from the dispenser panel 18 along a cut 23. In one embodiment, as shown in FIG. 1, the cut 23 can include a generally circular or ovoid portion 23*a*, and a pair of oblique cuts 23*b* extending obliquely from endpoints of the ovoid portion 23*a* relative to the centerline CL. In one embodiment, the cut 23 can include one or more lines of weakness (e.g., a partial cut, perforation line, tear line, a cut line with one or more nicks, etc.) that is suitable for allowing the dispenser flap 20 to separate from the dispenser panel 18 when the dispenser 16 is actuated, as described further herein.

The hinge 22 can be a line or region of weakening that intersects the cut 23 (e.g., the portions 23*b* of the cut 23) and that extends generally obliquely relative to the centerline CL. In one embodiment, the dispenser panel 18 can include a downwardly-extending face or step 19 along which the hinge 22 is at least partially positioned. It will be understood that the hinge 22 and/or the cut 23 could have an alternative configuration without departing from the disclosure.

Figure 3:
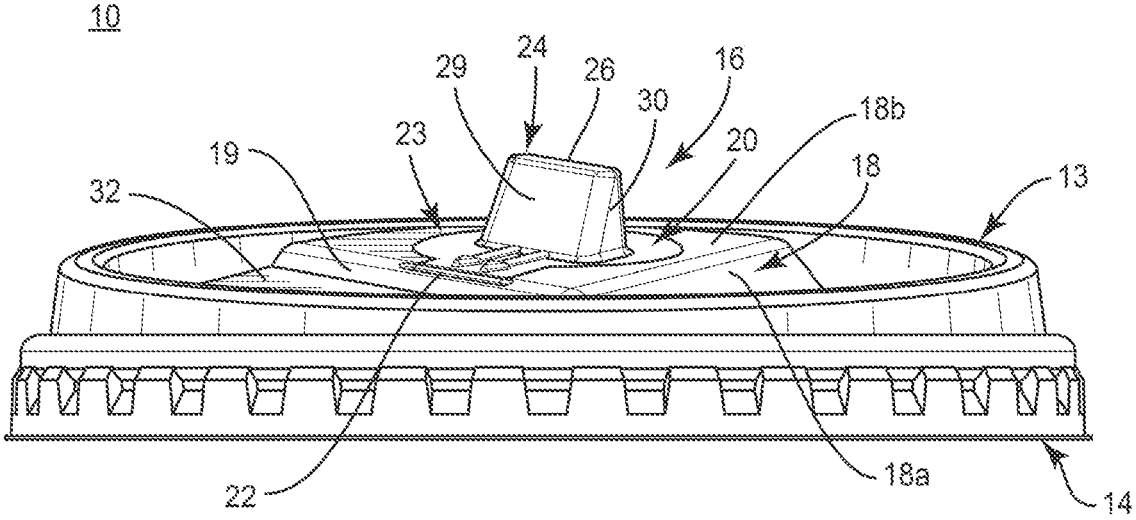
FIG. 3 is a rear view of the lid of FIG. 1.
Figure 4:
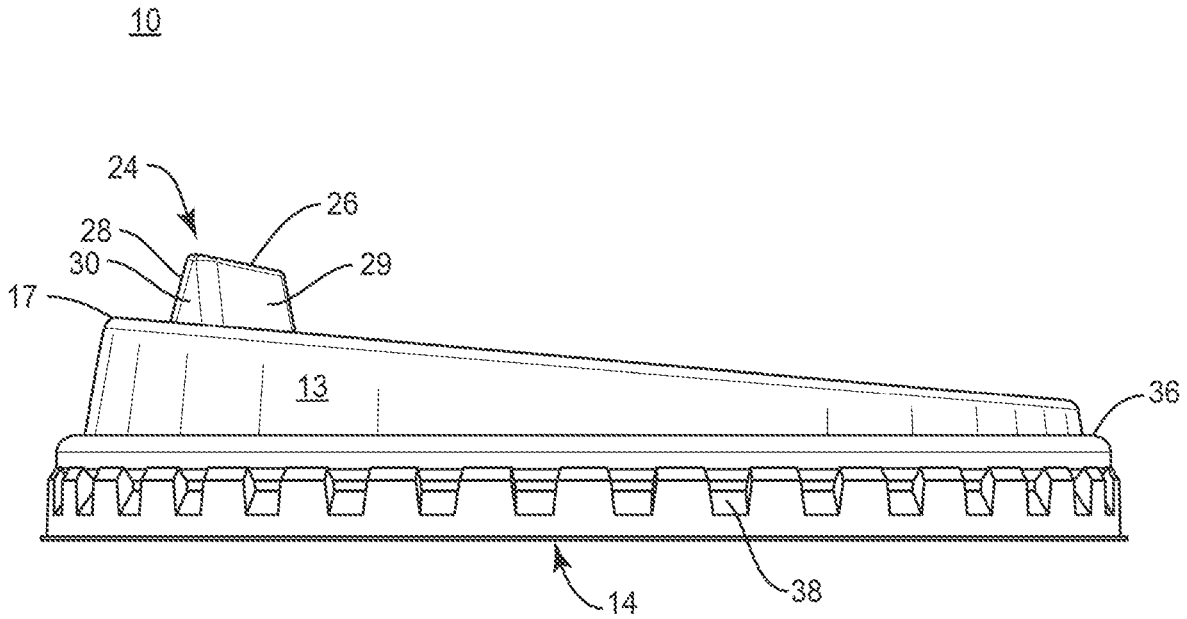
FIG. 4 is a side view of the lid of FIG. 1.

Still referring to FIGS. 1 and 3-7, the dispenser 16 further can include a protuberance or projection 24 with a top surface 26, a front surface 28, a rear surface 29, and side surfaces 30 extending between the top surface 26 and the front and rear surfaces 28, 29 (shown best in FIGS. 3-5). As shown, the projection 24 can include on or more regions of transition, e.g., bevels, ledges, steps, curves, chamfers, etc., between the respective surfaces. In one embodiment, one or more of the surfaces 26, 28, 29, 30 can include one or more curved or angled portions and/or surface features such as notches, recesses, lips, ledges, etc. In an exemplary embodiment, the dispenser flap 20 and the projection 24 can be considered a tab.

As shown in FIGS. 1 and 3-7, the projection 24 is spaced from the cut 23 in the dispenser flap 20 so that a portion of the dispenser flap 20 extends around the perimeter of the projection 24. In this regard, and as described further herein, the projection 24 is supported on the dispenser flap 20 so as to move in conjunction with the dispenser flap 20. The dispenser flap 20 and/or the projection 24 could be omitted or could be otherwise shaped, arranged, positioned, and/or configured without departing from the disclosure.

Still referring to FIGS. 1 and 3-7, a locking panel 32 can be supported on the central wall 12 of the lid 10 and positioned adjacent and/or abutting the dispenser panel 18. As shown, the locking panel 32 can be supported above the central wall 12 and below the dispenser panel 18, e.g., intersecting the step 19 of the dispenser panel 18 such that the dispenser panel 18, the locking panel 32, and the base panel 21 of the central wall 12 can have a stepped or staggered arrangement. As shown in FIGS. 1, 3, and 5, the dispenser panel 18 and the locking panel 32 can extend along at least a portion of the annular ridge 13.

In this regard, one or more regions of transition can be provided between respective portions of the dispenser panel 18, the locking panel 32, and the base panel 21 of the central wall 12, e.g., bevels, ledges, steps, curves, chamfers, etc. In the illustrated embodiment, the lid 10 can include a recessed area defined along at least the base panel 21 (e.g., for catching spilled liquid). In one embodiment, one or more of the dispenser panel 18, the locking panel 32, and the base panel 21 can be provided in a coplanar relationship. While the dispenser panel 18 and locking panel 32 have been described as panels supported above the base panel 21 of the central wall 12, it will be understood that one or both of the dispenser panel 18 and the locking panel 32 can be considered raised portions of the central wall 12 without departing from the disclosure.

The locking panel 32, as shown, can include a locking recess 34 that is an at least partially recessed portion of the locking panel 32 so as to have the form of, for example, a notch, divot, catch, etc. In the illustrated embodiment, the locking recess 34 extending in the locking panel 32 of the central wall 12 can have a generally complementary configuration to the projection 24 extending from the dispenser flap 20, e.g., so as to have surfaces generally corresponding to the surfaces 26, 28, 29, 30 of the projection 24 extending downwardly from the locking panel 32. In one embodiment, the locking recess 34 can have a generally triangular or wedge-shaped recessed configuration.

As shown in FIGS. 1 and 3-5, the dispenser 16 is in a closed configuration wherein the dispenser flap 20 engages, abuts, and/or is closely spaced from the dispenser panel 18 at the cut 23 to help prevent or reduce spilling or splashing of liquids in the container C through the dispenser 16 when the dispenser 16 is in a closed position.

In the illustrated embodiment, the locking recess 34 and at least a portion of the projection 24/dispenser flap 20 are locking features that can maintain the dispenser flap 20 in an actuated/open position and that are spaced away from the dispenser panel 18 so as to expose a dispenser opening 40 (FIGS. 6 and 7) that is at least partially surrounded by an edge 42 formed along the cut 23. Such dispenser opening 40 provides access to the interior of the container C and a passage through the dispenser 16 so that a user can pour or retrieve fluid contents of the container C therethrough, as described further herein.

The dispenser 16 and/or locking features could be otherwise shaped, arranged, positioned, and/or configured without departing from the disclosure.

In one embodiment, in operation, a user can at least partially fill a container, e.g., container C (FIG. 2) with liquid and/or solids and can engage the lid 10 with the top portion of the container C so that the container C and the lid 10 cooperate to enclose an interior space thereof (not shown) and form the container assembly 100 (FIGS. 5 and 6).

In the illustrated embodiment, the skirt 14 includes an internal annular groove 36 extending along the annular ridge 13 and a plurality of inwardly-extending protrusions 38 spaced along the circumference of the skirt 14 (FIGS. 3-6). As shown in FIG. 5, the protrusions 38 have upper surfaces that form a lower portion of the annular groove 36, and the upper surfaces of the protrusions 38 can be curved and/or sloped. When the lid 10 is engaged with the container C to at least partially close the top end of the container C, the lid 10 can be placed over the rim R of the container C so that the skirt 14 engages the rim R. The lid 10 can be pressed downwardly onto the container C so that sloped lower surfaces of the protrusions 38 engage the rim R. In one embodiment, the downward pressure on the lid 10 can cause the rim R to push outwardly on the sloped surfaces of the protrusions 38, causing the skirt 14 to pivot (e.g., bend, flex, and/or fold) outwardly so that the protrusions 38 can move past the rim R as the lid 10 is pushed downwardly. Accordingly, the lid 10 can snap onto the rim R as the protrusions 38 move past the rim R and the rim R is engaged in the annular groove 36. The skirt 14 can move back to its original position with the protrusions 38 engaged with an underside of the rim R at their upper surfaces. The snap-fit engagement of the rim R with the annular groove 36 and the protrusions 38 can help retain the lid 10 in engagement with the container C so that purposeful bending force can be required on the skirt 14 to remove the lid 10. In embodiments, the container assembly 100 is formed when the lid 10 is engaged with the container C. As shown in FIGS. 5 and 6, the annular skirt 14 can extend downwardly with respect to the central wall 12 along a portion (e.g., an upper portion) of the container C in the container assembly 100. The skirt 14 could be omitted or could be otherwise shaped, arranged, positioned, and/or configured without departing from the disclosure. For example, the lid 10 could be otherwise configured to engage the container C.

Figure 7:
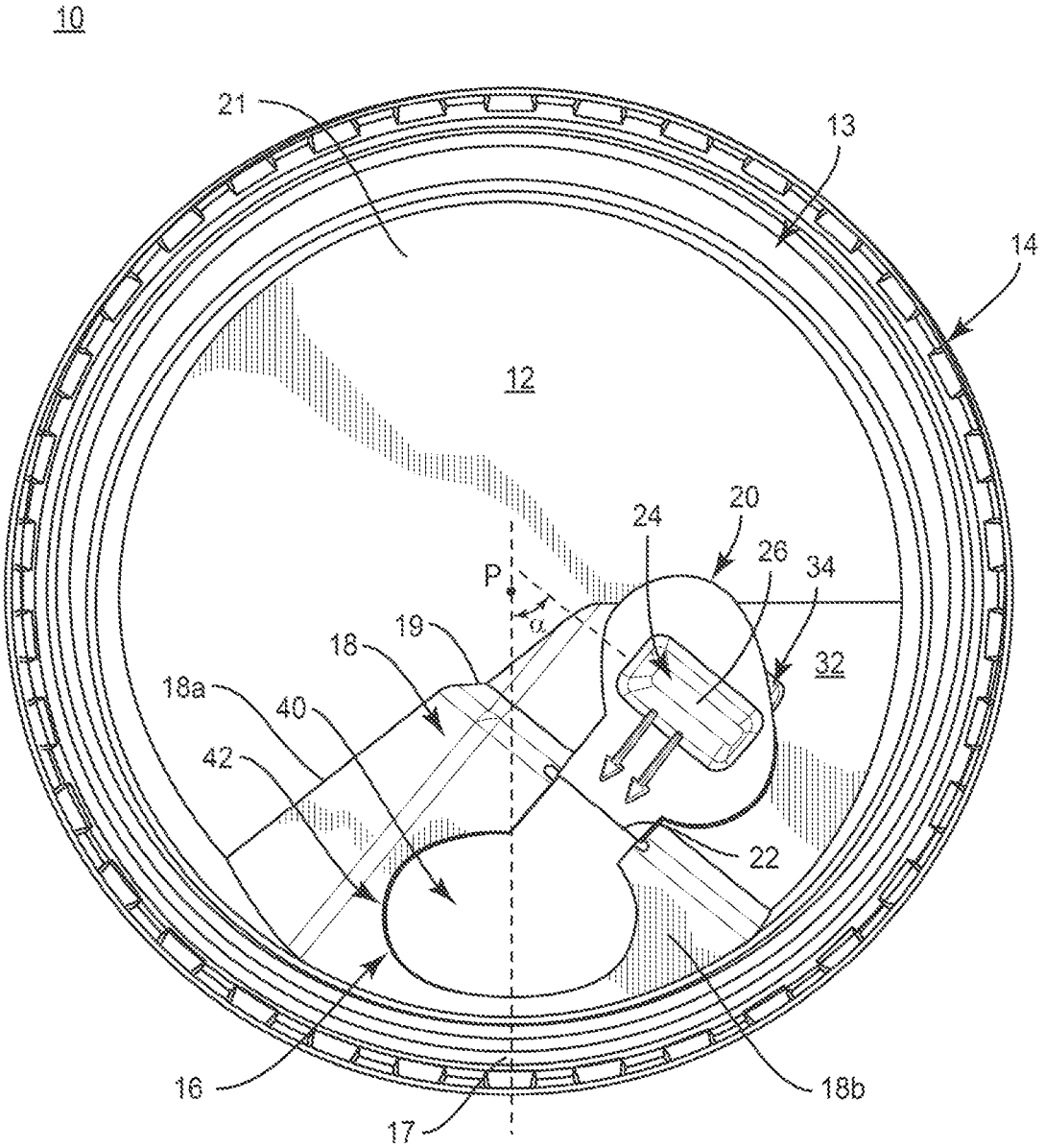
FIG. 7 is a top plan view of the lid of FIG. 1 with the dispensing feature in the open configuration of FIG. 6.

The dispenser flap 20 in the closed position of FIGS. 1 and 3-5 can help prevent splashing and/or spilling of liquid from the interior of the container. As shown in FIGS. 6 and 7, the dispenser 16 can be actuated to an open or dispensing configuration (e.g., for drinking a beverage through the dispenser 16). In one embodiment, the dispenser 16 can be actuated by engagement of the projection 24 by a user, for example, contact with a user's thumb and/or forefinger, to cause at least partial separation of the dispenser flap 20 from the dispenser panel 18 at the cut 23. Further movement/urging of the projection 24 by the user can cause the dispenser flap 20 and the projection 24 carried thereon to fold/pivot/flex at the hinge 22 in the direction of the arrow A1 (FIG. 6), e.g., toward the locking panel 32. In this regard, a user can pivot/fold/flex the dispenser flap 20 to position the projection 24 at least partially within the locking recess 34, and one or more of the surfaces 26, 28, 29, 30 of the projection 24 can engage a corresponding surface of the locking recess 34 to maintain the projection 24 in a position so as to be at least partially received by the locking recess 34. In one embodiment, such engagement of the projection 24 and the locking recess 34 can be facilitated by an interference fit, friction fit, compression of the projection 24 by the locking recess 34, etc.

As shown in FIGS. 6 and 7, the separation of the dispenser flap 20 from the dispenser panel 18 along the cut 23 forms the dispenser opening 40 with the edge 42 of the dispenser panel 18 and the hinge 22 extending along the opening 40. Accordingly, a user can access the beverage or other liquid in the interior of the container C through the dispenser opening 40. It will be understood that the dispenser 16 can be closed by reversing the steps outlined above, e.g., by disengaging the projection 24/dispenser flap 20 from the locking recess 34 (e.g., by pulling upwardly on the dispenser flap 20) and pivoting/folding/flexing the dispenser flap 20 at the hinge 22 toward the opening 40 and at least partially covering the dispenser opening 40 with the dispenser flap 20.

As shown, the oblique arrangement of the hinge 22 relative to the centerline CL and the positioning of the locking recess 34 at a location spaced away from the centerline CL provides for movement of the dispenser flap 20 away from the centerline CL when the dispenser 16 is opened. In this regard, when the projection 24 is at least partially engaged/recessed within the locking recess 34, the dispenser flap 20 is spaced away from the centerline CL and below the dispenser panel 18. As shown in FIG. 7, the top surface 26 of the projection 24 can generally extend at an angle $\alpha$ relative to the centerline CL, wherein $0°<\alpha<90°$. In one embodiment, the hinge 22 also can extend at the angle $\alpha$ with respect to the centerline CL.

Such arrangement of the dispenser flap 20 spaced away from the centerline CL and/or below the dispenser panel 18 provides the dispenser panel 18 as the uppermost surface within the annular ridge 13 so as to provide an enhanced clearance for a user engaging the lid 10. For example, when the dispenser flap 20 is in the open position and locked in the locking recess 34, the user can place his or her mouth on the lid 10 near the dispenser 16 (e.g., at portion 17 of the annular ridge 13) and tilt the container C toward himself or herself such that no portion of the dispenser flap 20, locking panel 32, and/or central wall 12 extends above the dispenser panel 18, e.g., so as to avoid contact with one or more facial features (e.g., nose) of the user.

Additionally, or alternatively, the oblique arrangement of the hinge 22 relative to the centerline CL of the lid 10 and the positioning of the locking recess 34 away from the centerline CL of the lid 10 provides for movement of the dispenser flap 20 along a path that provides a maximized surface of the central wall 12 available for printing, embossing, debossing, or otherwise marking with indicia related to product information, advertising, price coding, and other information or images or features. In this regard, the arrangement and positioning of the hinge 22, locking recess 34, and the path along which the dispenser flap 20 moves between open and closed/locked positions is such that an enhanced clearance for user engagement of the lid 10 and available surface area for printing or other indicia on the central wall 12 is provided, for example, as compared to a lid configuration in which a hinge for a dispenser flap and/or a locking feature for the dispenser flap is located along a centerline thereof. Stated another way, the dispenser 16, the dispenser panel 18, the locking panel 32, and the locking recess 34 generally are arranged along the annular ridge 13 of the lid 10 rather than extending toward the center of the lid 10. Accordingly, the base panel 21 of the central wall 12 can have more contiguous area, e.g., for larger logos or other information or features than would be possible in other embodiments where the area is interrupted by the dispenser and/or locking features.

Any of the features of the various embodiments of the disclosure can be combined with, replaced by, or otherwise configured with other features of other embodiments of the disclosure without departing from the scope of this disclosure.

The containers and/or the blanks that form the containers according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the container to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

The above embodiments may be described as having one or more portions adhered together by glue during erection of the container embodiments. The term "glue" is intended to encompass all manner of adhesives commonly used to secure containers in place.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A lid for a container, the lid comprising:

a central wall;

a dispenser comprising a dispenser flap hingedly connected to the central wall along a hinge and moveable between a closed configuration and an open configuration at least partially exposing a dispenser opening in the central wall, and a projection extending from the dispenser flap, wherein the dispenser comprises a dispenser panel supported above a base panel of the central wall, and the dispenser flap is separable from the dispenser panel, and wherein the dispenser panel includes a downwardly-extending step; and a locking feature for maintaining the dispenser in the open configuration, the locking feature comprising a locking recess in the central wall for at least partially receiving the projection, wherein the locking feature extends in a locking panel and is supported above the base panel of the central wall and below the dispenser panel, wherein the locking panel intersects with the downwardly extending step, and wherein the dispenser opening is located on a centerline of the lid and the locking recess is spaced away from the centerline of the lid;

an annular ridge extending upwardly from the central wall, wherein the locking panel extends along at least portion of the annular ridge.

2. The lid of claim 1, wherein the centerline extends through at least a portion of the dispenser flap when the dispenser is in the closed configuration.

3. The lid of claim 2, wherein the hinge extends in an oblique direction with respect to the centerline.

4. The lid of claim 1, wherein the dispenser flap is spaced apart from the centerline when the projection is at least partially received in the locking recess.

5. The lid of claim 1, wherein the dispenser panel is an uppermost surface within the annular ridge when the dispenser is in the open configuration and the projection is at least partially received in the locking recess.

6. The lid of claim 1, wherein the dispenser panel, the locking panel, and the base panel of the central wall are in a stepped arrangement.

7. The lid of claim 1, further comprising an annular skirt extending downwardly from the central wall and the annular ridge extends upwardly from the central wall.

8. A method of forming a lid for a container, the method comprising:

forming a central wall, a dispenser, a locking feature for maintaining the dispenser in an open configuration, and an annular ridge extending upwardly from the central wall;

the dispenser comprises a dispenser flap hingedly connected to the central wall along a hinge and moveable between a closed configuration and the open configuration at least partially exposing a dispenser opening in the central wall, and a projection extending from the dispenser flap, wherein the dispenser comprises a dispenser panel supported above a base panel of the central wall, and the dispenser flap is separable from the dispenser panel, wherein the dispenser panel includes a downwardly-extending step, and wherein the dispenser opening is located on a centerline of the lid; and the locking feature comprises a locking recess in the central wall for at least partially receiving the projection, wherein the locking feature extends in a locking panel and is supported above the base panel of the central wall and below the dispenser panel, wherein the locking panel intersects with the downwardly extending step, and wherein the forming the central wall, the dispenser, and the locking feature comprises forming the locking recess at a location spaced away from the centerline of the lid;

wherein the locking panel extends along at least portion of the annular ridge.

9. The method of claim 8, wherein the hinge extends in an oblique direction with respect to the centerline.

10. The method of claim 8, wherein the dispenser flap is separable from the dispenser panel.

11. A container assembly comprising a lid engaged with a container, the lid comprising:

a central wall;

an annular skirt extending downwardly with respect to the central wall and along at least a portion of the container;

an annular ridge extending upwardly from the central wall;

a dispenser comprising a dispenser flap hingedly connected to the central wall along a hinge and a projection extending from the dispenser flap, the dispenser flap extending along at least a portion of a centerline of the lid when the dispenser flap is in a closed configuration, wherein the dispenser comprises a dispenser panel supported above a base panel of the central wall, and the dispenser flap is separable from the dispenser panel, and wherein the dispenser panel includes a downwardly-extending step; and a locking feature for maintaining the dispenser in an open configuration, the locking feature comprising a locking recess for at least partially receiving the projection, wherein the locking feature extends in a locking panel and is supported above the base panel of the central wall and below the dispenser panel and the locking panel extends along at least portion of the annular ridge, wherein the locking panel intersects with the downwardly extending step, and wherein the locking recess is spaced away from the centerline of the lid.

12. The container assembly of claim 11, wherein the hinge extends in an oblique direction with respect to the centerline.

13. The container assembly of claim 11, wherein the dispenser panel, the locking panel, and the base panel of the central wall are in a stepped arrangement.

14. A method of forming a container assembly, comprising:

obtaining a lid comprising:

a central wall;

an annular skirt extending downwardly with respect to the central wall;

an annular ridge extending upwardly from the central wall;

a dispenser comprising a dispenser flap hingedly connected to the central wall along a hinge and a projection extending from the dispenser flap, wherein the dispenser flap extends along at least a portion of a centerline of the lid when the dispenser flap is in a closed configuration, wherein the dispenser comprises a dispenser panel supported above a base panel of the central wall, and the dispenser flap is separable from the dispenser panel, and wherein the dispenser panel includes a downwardly-extending step; and a locking feature for maintaining the dispenser in an open configuration, the locking feature comprising a locking recess for at least partially receiving the projection, wherein the locking feature extends in a locking panel and is supported above the base panel of the central wall and below the dispenser panel and the locking panel extends along at least portion of the annular ridge, wherein the locking panel intersects with the downwardly extending step, and wherein the locking recess is spaced away from the centerline of the lid; and attaching the lid to an upper portion of the container so that the annular skirt extends along at least a portion of the container.

15. The method of claim 14, wherein the hinge extends in an oblique direction with respect to the centerline.

16. The method of claim 14, wherein the dispenser panel is an uppermost surface within the annular ridge when the dispenser is in the open configuration and the projection is at least partially received in the locking recess.

17. The lid of claim 1, wherein the dispenser panel comprises a side portion extending upwardly from the base panel of the central wall to a top portion of the dispenser panel, and the dispenser flap extends in at least the top portion of the dispenser panel.

18. The lid of claim 1, wherein the hinge is at least partially positioned along the downwardly extending step.

19. The lid of claim 1, wherein the dispenser panel comprises a side portion extending upwardly from the base panel of the central wall to a top portion of the dispenser panel, and the downwardly extending step extends from the top portion of the dispenser panel to the locking panel.

20. The container assembly of claim 11, wherein the dispenser panel comprises a side portion extending upwardly from the base panel of the central wall to a top portion of the dispenser panel, and the dispenser flap extends in at least the top portion of the dispenser panel.

21. The container assembly of claim 11, wherein the hinge is at least partially positioned along the downwardly extending step.

22. The container assembly of claim 11, wherein the dispenser panel comprises a side portion extending upwardly from the base panel of the central wall to a top portion of the dispenser panel and a downwardly extending step extending from the top portion of the dispenser panel to the locking panel.

* * * * *